US007873431B2

(12) United States Patent
Takahashi et al.

(10) Patent No.: US 7,873,431 B2
(45) Date of Patent: Jan. 18, 2011

(54) WORKPIECE TRANSFER APPARATUS, CONTROL METHOD FOR WORKPIECE TRANSFER APPARATUS, AND PRESS LINE

(75) Inventors: Takeshi Takahashi, Yokohama (JP); Hajime Banno, Yokohama (JP); Shusaku Yamasaki, Yokohama (JP)

(73) Assignee: IHI Corporation (JP)

( * ) Notice: Subject to any disclaimer, the term of this patent is extended or adjusted under 35 U.S.C. 154(b) by 638 days.

(21) Appl. No.: 11/916,607

(22) PCT Filed: Jun. 6, 2006

(86) PCT No.: PCT/JP2006/311265

§ 371 (c)(1),
(2), (4) Date: Dec. 5, 2007

(87) PCT Pub. No.: WO2006/132201

PCT Pub. Date: Dec. 14, 2006

(65) Prior Publication Data

US 2010/0021274 A1 Jan. 28, 2010

(30) Foreign Application Priority Data

Jun. 6, 2005 (JP) ..... 2005-165775

(51) Int. Cl.
*G06F 19/00* (2006.01)

(52) U.S. Cl. ..... 700/112; 700/206

(58) Field of Classification Search ..... 700/112, 700/114, 206; 414/222.02
See application file for complete search history.

(56) References Cited

U.S. PATENT DOCUMENTS 4,627,253 A 12/1986 Tennessen et al. ..... 72/4
2006/0169020 A1 * 8/2006 Takayama ..... 72/405.1

FOREIGN PATENT DOCUMENTS

JP 11-104900 4/1999
JP 2004-195485 7/2004
JP 2005-216112 8/2005

(Continued)

OTHER PUBLICATIONS

Canadian Office Action, dated Oct. 6, 2009, issued in corresponding Canadian Patent Application No. 2,610,880, total 3 pages.

(Continued)

*Primary Examiner*—Ryan A Jarrett
(74) *Attorney, Agent, or Firm*—Ostrolenk Faber LLP

(57) ABSTRACT

By adopting a workpiece transfer apparatus, which grips a workpiece by use of a predetermined grip device and transfers the workpiece between press apparatuses each of which drives a die, including a transfer control device for controlling a position of the grip device based on a resultant target value obtained by combining a die position of a press apparatus located on an upstream side of a workpiece transfer direction (an upstream side die position) and a die position of a press apparatus located on a downstream side of a workpiece transfer direction (a downstream side die position), in which the transfer control device sets a resultant target value so that the grip device moves smoothly, it becomes possible to suppress vibration in a workpiece transfer apparatus in a press line.

14 Claims, 7 Drawing Sheets

FOREIGN PATENT DOCUMENTS

| | | | |
|---|---|---|---|
| KR | 10-0345256 | B1 | 11/2002 |
| KR | 10-20030091668 | A | 12/2003 |
| RU | 2 041 001 | | 8/1995 |
| RU | 2 116 855 | | 8/1998 |
| TW | 330856 | | 5/1998 |

OTHER PUBLICATIONS

Japanese Office Action dated Jun. 30, 2008 with translation.
Search Report in PCT/JP2006/311265 dated Sep. 12, 2006.
Decision of Grant issued on May 13, 2009 in the counterpart Russian Patent Application No. 2007145354, with English language translation (11 pages).

Notice of Allowance issued in corresponding Korean Patent Application No. 10-2007-7028337 dated Jan. 11, 2010, with English Translation (3 pages total).

* cited by examiner

WORKPIECE TRANSFER APPARATUS, CONTROL METHOD FOR WORKPIECE TRANSFER APPARATUS, AND PRESS LINE

CROSS REFERENCE TO RELATED APPLICATION

The present application is a 35 U.S.C. §§371 national phase conversion of PCT/JP2006/311265, filed Jun. 6, 2006, which claims priority of Japanese Patent Application No. 2005-165775, filed Jun. 6, 2005, the disclosure of which has been incorporated herein by reference. The PCT International Application was published in the Japanese language.

TECHNICAL FIELD

The present invention relates to a workpiece transfer apparatus, a control method for a workpiece transfer apparatus, and a press line.

Priority is claimed on Japanese Patent Application No. 2005-165775, filed on Jun. 6, 2005, the contents of which are incorporated herein by reference.

BACKGROUND ART

As a control method for a press apparatus and a workpiece transfer apparatus in a tandem press line, a phase difference control method is conventionally known. In this phase difference control method, the die position, that is, the press angle of a press apparatus on the upstream side of the tandem press line and that of a press apparatus on the down stream side of the tandem press line are controlled to have a predetermined phase difference so that a workpiece transfer apparatus does not interfere with the dies when carrying in and carrying out a workpiece. Such a phase difference control method can transfer a workpiece without stopping the upstream side press apparatus and the downstream side press apparatus, and allows a single workpiece transfer apparatus to smoothly transfer a workpiece between the aforementioned press apparatuses without interfering with the dies. Therefore, it has advantages in that productivity is high and apparatus costs are low.

For example, a technique relating to a control method using a phase difference control method as described above is disclosed in Japanese Unexamined Patent Application, First Publication No. 2004-195485. This technique controls a workpiece transfer apparatus synchronously with the press angle of an upstream side press apparatus in a die interference zone when the workpiece is carried out from the upstream side press apparatus, and controls the workpiece transfer apparatus synchronously with the press angle of a downstream side press apparatus in a die interference zone when the workpiece is carried in to the downstream side press apparatus. Furthermore, it controls the workpiece transfer apparatus based on a control signal outputted from predetermined signal generation device in transfer zones other than the aforementioned die interference zones. Since such a signal generation device for controlling the transfer zones is provided, the workpiece transfer apparatus can be operated even when the upstream side press apparatus and/or the downstream side press apparatus are stopped. Therefore, it is possible to improve the production efficiency.

Patent Document 1: Japanese Unexamined Patent Application, First Publication No. 2004-195485

DISCLOSURE OF INVENTION

Problems to be Solved by the Invention

However, the aforementioned conventional technique has a problem in that there arises a sudden change in the control amount inputted to the workpiece transfer apparatus at the boundary between a die interference zone and a transfer zone. This change will result in vibration in the workpiece transfer apparatus and leads to falling of the workpiece or a failure in the workpiece transfer apparatus. To suppress this vibration in the workpiece transfer apparatus, a conceivable way is to enhance the mechanical rigidity of the workpiece transfer apparatus. However, enhancing the rigidity increases the weight of movable portions, thus leading to a problem that consumption energy for operating the workpiece transfer apparatus increases and that the apparatus costs also increase. The present inventors believe that workpiece transfer apparatuses in future need to be made lighter and smaller to decrease consumption energy and also to make apparatus costs lower, and consequently files the present invention.

The present invention has been achieved in view of the aforementioned circumstances, and has an object to suppress vibration in a workpiece transfer apparatus when a workpiece is transferred without enhancing the mechanical rigidity of the workpiece transfer apparatus.

Means for Solving the Problem

To achieve the aforementioned object, the present invention adopts, as a first solution to a workpiece transfer apparatus, a workpiece transfer apparatus which grips a workpiece by use of a predetermined grip device and transfers the workpiece between press apparatuses each of which drives a die, including a transfer control device for controlling a position of the grip device based on a resultant target value obtained by combining a die position of a press apparatus located on the upstream side of a workpiece transfer direction (an upstream side die position) and a die position of a press apparatus located on a downstream side of a workpiece transfer direction (a downstream side die position), in which the transfer control device sets a resultant target value so that the grip device moves smoothly.

The present invention adopts, as a second solution to a workpiece transfer apparatus, the workpiece transfer apparatus in accordance with the aforementioned first solution in a case where an upstream side die position is given as a press angle θu (an upstream side press angle) and a downstream side die position is given as a press angle θd (a downstream side press angle) by respective press apparatuses, the transfer control device sets a resultant target angle θr as a resultant target value, in which the resultant target angle θr is obtained by substituting the upstream side press angle θu and the downstream side press angle θd into the following synthesis equation (1) which is related to a phase difference Δθp between the two press angles and a weighting coefficient W:

$$\theta r = W \cdot \theta u + (1 - W) \cdot (\theta d + \Delta\theta p) \quad (1)$$

The present invention adopts, as a third solution to a workpiece transfer apparatus, the workpiece transfer apparatus in accordance with the aforementioned first solution, in a case where an upstream side die position is given as a press angle θu (an upstream side press angle) and a downstream side die position is given as a press angle θd (a downstream side press angle) by respective press apparatuses, the transfer control device acquires a first coordinates (Xu,Yu) of the grip device based on the upstream side press angle θu. And at the same time, the transfer control device acquires a second coordinates (Xd,Yd) of the grip device based on the downstream side press angle θd, and then sets resultant target coordinates (Xr,Yr) as a resultant target value. Here, the resultant target coordinates (Xr,Yr) is obtained by substituting the first coordinates (Xu,Yu) and the second coordinates (Xd,Yd) into the following synthesis equations (4) and (5) which are related to a weighting coefficient W:

$$Xr=W\cdot Xu+(1-W)Xd \quad (4)$$

$$Yr=W\cdot Yu+(1-W)Yd \quad (5)$$

The present invention is characterized by, as a fourth solution to a workpiece transfer apparatus, the workpiece transfer apparatus in accordance with the aforementioned second or third solution, in which the weighting coefficient W represents a decreasing and continuous function value which takes the upstream side press angle θu as a variable.

The present invention adopts, as a fifth solution to a workpiece transfer apparatus, the workpiece transfer apparatus in accordance with the aforementioned first solution, in a case where an upstream side die position is given as a press angle θu (an upstream side press angle) and a downstream side die position is given as a press angle θd (a downstream side press angle) by respective press apparatuses, the transfer control device sets the resultant target value. The resultant target value is set by retrieving, based on the upstream side press angle θu and the downstream side press angle θd which are given by the respective press apparatuses, a table in which resultant target values are set in advance with the upstream side press angle θu and the downstream side press angle θd as variables.

The present invention adopts, as a sixth solution relating to a workpiece transfer apparatus, the workpiece transfer apparatus in accordance with the aforementioned first solution, in a case where an upstream side die position is given as a press angle θu (an upstream side press angle) and a downstream side die position is given as a press angle θd (a downstream side press angle) by respective press apparatuses, the transfer control device acquires first coordinates (Xu,Yu) of the grip device as a calculated value based on the upstream side press angle θu. And at the same time, the transfer control device acquires second coordinates (Xd,Yd) of the grip device as a calculated value based on the downstream side press angle θd, and then sets the resultant target value by retrieving, based on the calculated values, a table in which resultant target values are set in advance with the first coordinates (Xu,Yu) and the second coordinates (Xd,Yd) as variables.

On the other hand, the present invention adopts, as a first solution to a control method for a workpiece transfer apparatus, a control method for a workpiece transfer apparatus which grips a workpiece by use of a predetermined grip device and transfers the workpiece between press apparatuses each of which drives a die. The control method includes a step of controlling a position of the grip device based on a resultant target value obtained by combining a die position of a press apparatus located on an upstream side in a workpiece transfer direction (an upstream side die position) and a die position of a press apparatus located on a downstream side (a downstream side die position), in which a resultant target value is set in the step so that the grip device moves smoothly.

Furthermore, the present invention adopts, as a first solution to a press line, a press line which includes a plurality of press apparatuses which are arranged at predetermined intervals and each of which drives a die, and a workpiece transfer apparatus which is provided between an upstream side press apparatus and a downstream side press apparatus and which adopts any of the first to sixth solutions relating to the aforementioned workpiece transfer apparatus to transfer a workpiece.

EFFECTS OF THE INVENTION

In accordance with the present invention, a workpiece transfer apparatus which grips a workpiece by use of a predetermined grip device and transfers the workpiece between press apparatuses each of which drives a die, is characterized by including a transfer control device for controlling a position of the grip device based on a resultant target value obtained by combining an upstream side die position and a downstream side die position, in which the transfer control device sets a resultant target value so that the grip device smoothly moves. That is, smooth movement of the grip device can prevent sudden acceleration and deceleration of the grip device, and can suppress vibration in the workpiece transfer apparatus. In addition, this can prevent a workpiece from falling and damage to portions of the workpiece transfer apparatus with low mechanical rigidity (in other words, there is no need to enhance mechanical rigidity of the workpiece transfer portion R).

BRIEF DESCRIPTION OF THE REFERENCE SYMBOLS

A: upstream side press apparatus, B: downstream side press apparatus, WC: workpiece transfer apparatus, C: control portion, c1: target value calculation portion, c2: servo motor driver, R workpiece transfer portion, r11: workpiece grip portion, P: workpiece

BEST MODE FOR CARRYING OUT THE INVENTION

First Embodiment

Hereunder is a description of a first embodiment of the present invention with reference to the drawings.

Figure 1:
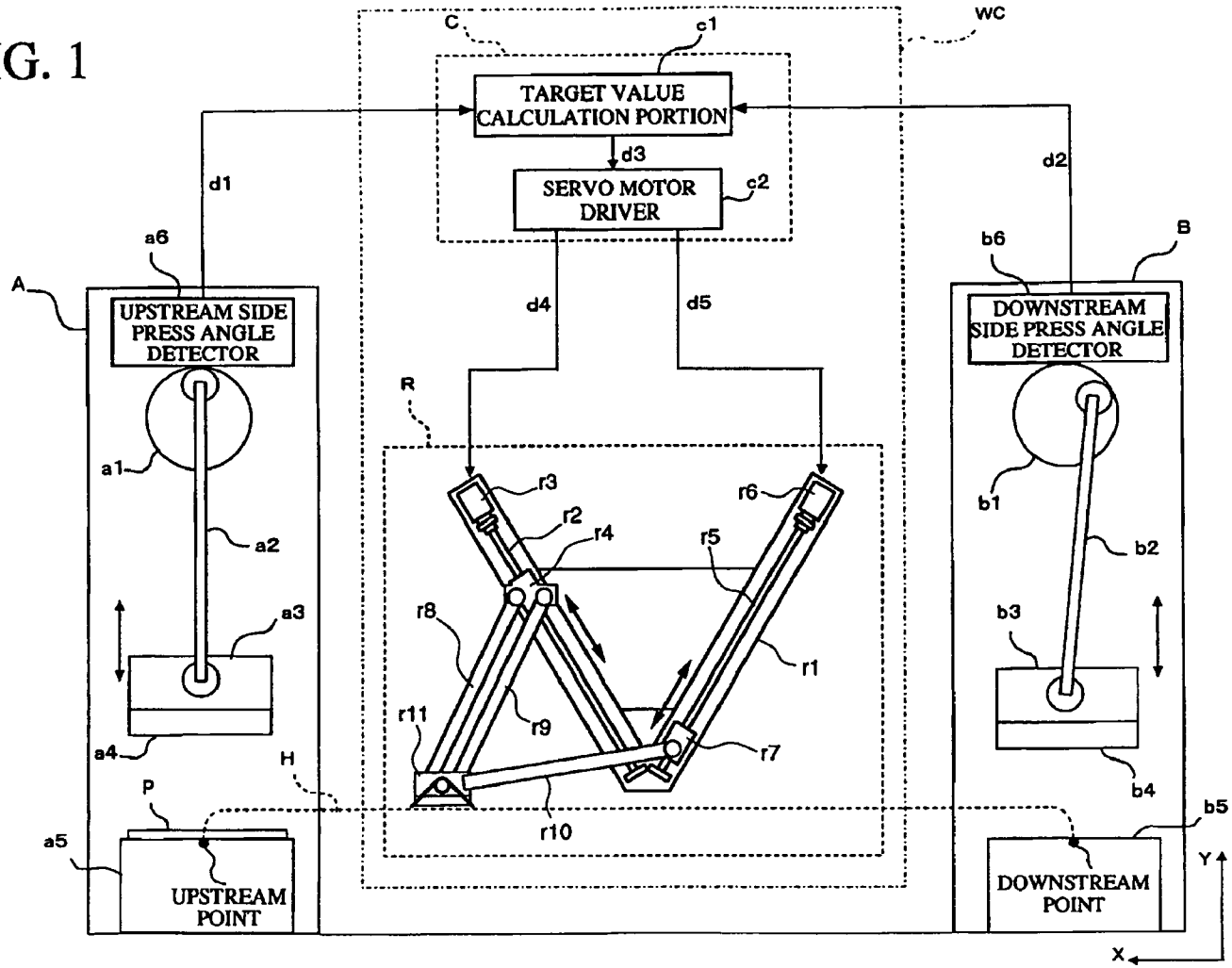
FIG. 1 is a schematic diagram showing a configuration of a phase difference control type tandem press line provided with a workpiece transfer apparatus in accordance with a first embodiment of the present invention.

FIG. 1 is a schematic diagram showing a configuration of a phase difference control type tandem press line provided with a workpiece transfer apparatus in accordance with this first embodiment of the present invention. In this figure, the reference symbol A denotes an upstream side press apparatus; B denotes a downstream side press apparatus; WC denotes a workpiece transfer apparatus; and P denotes a workpiece. The workpiece transfer apparatus WC is made of: a control portion C including a target value calculation portion c1 and a servo motor driver c2; and a workpiece transfer portion R. In FIG. 1, a feed (forward) direction of the workpiece P defines the X axis direction and the lift (perpendicular) direction thereof defines the Y axis direction.

As shown in FIG. 1, the upstream side press apparatus A and the downstream side press apparatus B are provided spaced apart across a workpiece transfer zone. The workpiece P is transferred from the upstream side press apparatus A to the downstream side press apparatus B through a transfer path H (from an upstream point to a downstream point) by the workpiece transfer apparatus WC (more specifically, a workpiece grip portion r11) which is provided in the workpiece transfer zone. In the actual tandem press line, a plurality of press apparatuses is provided in a similar configuration on a further downstream side of the downstream side press apparatus B. However, they are omitted in the present embodiment.

The upstream side press apparatus A is made of: a press main gear a1; a press rod a2; a die mount portion (a slider) a3; an upstream side die a4; a workpiece stage a5; and an upstream side press angle detector a6. The press main gear a1 and one end of the press rod a2 are connected to each other rotatably with respect to a vertical axis of the XY plane. Similarly, the other end of the press rod a2 and the slider a3 are connected to each other rotatably with respect to a vertical axis of the XY plane. These press main gear a1, press rod a2, and slider a3 constitute a crank mechanism, and consequently the slider a3 is driven reciprocatingly in the Y axis direction by means of rotary drive from the press main gear a1. The upstream side die a4 is mounted to a bottom portion of the slider a3. Similarly to the slider a3, the upstream side die a4 moves reciprocatingly in the Y axis direction. The workpiece stage a5 is a stage for pressing the workpiece P. Molding is performed by pressing the workpiece P on this workpiece stage a5 with the upstream side die a4. The upstream side press angle detector a6 is, for example, an encoder. It detects a rotation angle (an upstream side press angle) θu of the press main gear a1 and outputs an upstream side press angle signal d1 which shows the aforementioned upstream side press angle θu to the target value calculation portion c1. This upstream side press angle θu shows a position of the upstream side die a4 in the Y axis direction.

The downstream side press apparatus B is made of: a press main gear b1; a press rod b2; a slider b3; a downstream side die b4; a workpiece stage b5; and a downstream side press angle detector b6. Description of like constituent parts to the above upstream side press apparatus A is omitted. Here, the downstream side press angle detector b6 detects a rotation angle (a downstream side press angle) θd of the press main gear b1 and outputs a downstream side press angle signal d2 which shows the downstream side press angle θd to the target value calculation portion c1.

Although not shown in the figure, the upstream side press apparatus A and the downstream side press apparatus B are respectively provided with a driving unit for driving the press main gear a1 and the press main gear b1, respectively. The press main gear a1 and press main gear b1 are rotary driven with a predetermined phase difference (a planned phase difference Δθp).

The workpiece transfer portion R is a robotic arm for transferring a workpiece, with a V-shaped parallel link mechanism. It is made of: a V-shaped base portion r1; a first ball screw r2; a first servo motor r3; a first slide r4; a second ball screw r5; a second servo motor r6; a second slide r7; a first link arm r8; a second link arm r9; a third link arm r10; and a workpiece grip portion r11.

The V-shaped base portion r1 is a bilaterally symmetrical V-shaped base member for a robotic arm. It is installed between the upstream side press apparatus A and the downstream side press apparatus B by mounting to an arm provided to a press stand not shown in the figure, or by hanging from the ceiling, etc. The first ball screw r2, the first servo motor r3, and the first slide r4 constitute a translatory actuator. Rotation of the first servo motor r3 connected with the first ball screw r2 linearly drives the first slide r4. Similarly, the second ball screw r5, the second servo motor r6, and the second slide r7 constitute a translatory actuator. Rotation of the second servo motor r6 connected with the second ball screw r5 linearly drives the second slide r7. These translatory actuators are installed on the V-shaped base portion r1 in a bilaterally symmetrical manner. They are independently drive-controlled respectively by a first servo motor drive signal d4 and a second servo motor drive signal d5 respectively inputted to the first servo motor r3 and the second servo motor r6 from the servo motor driver c2 of the control portion C.

One ends of the first link arm r8 and the second link arm r9 are connected to the first slide r4 rotatably with respect to a vertical axis of the XY plane; the other ends thereof are connected to the workpiece grip portion r11 also rotatably with respect to a vertical axis of the XY plane. On the other hand, one end of the third link arm r10 is connected to the second slide r7 rotatably with respect to a vertical axis of the XY plane; the other end thereof together with the other end of the second link arm r9 is connected to the workpiece grip portion r11 also rotatably with respect to a vertical axis of the XY plane. The first link arm r8, the second link arm r9, and the third link arm r10 are equal in arm length, and the first link arm r8 and the second link arm r9 are connected so as to be parallel to each other. A vacuum attraction cup is provided to the bottom portion of this workpiece grip portion r11 to suction grip the workpiece P.

As described above, the first slide r4, the second slide r7, the first link arm r8, the second link arm r9, the third link arm r10, and the workpiece grip portion r11 constitute a link mechanism. Consequently, the first slide r4 and the second slide r7 are linearly driven independently with each other under the control of the control portion C, and thereby, XY coordinates (a target transfer position) of the workpiece grip portion r11 on the transfer path H is controlled.

In the control portion C, the target value calculation portion c1 has already stored a weighting function W(θu) which takes the upstream side press angle θu as a variable. It calculates a weighting coefficient W by substituting the upstream side press angle θu obtained from the upstream side press angle signal d1 into the weighting function W(θu), and then calculates a resultant target angle θr based on the upstream side press angle θu, the downstream side press angle θd, the previously-stored planned phase difference Δθp, and the following synthesis equation (1) relating to the aforementioned weighting coefficient W.

$$\theta r = W \cdot \theta u + (1 - W) \cdot (\theta d + \Delta\theta p) \quad (1)$$

Furthermore, the target value calculation portion c1 has already stored motion profile functions which define a target transfer position of the workpiece grip portion r11, that is, XY coordinates of the workpiece grip portion r1 on the transfer path H. It acquires the target transfer position of the workpiece grip portion r11 by substituting the resultant target angle θr calculated from the aforementioned synthesis equation (1) into the aforementioned motion profile functions, transforms the aforementioned target transfer position into a target rotation angle of the first servo motor r3 and the second servo motor r6, and then outputs a target rotation angle signal d3 which shows the aforementioned target rotation angle to the servo motor driver c2. A detailed description of the weighting function W(θu), planned phase difference Δθp, and motion profile functions as described above will be given later.

Based on the above target rotation angle signal d3, the servo motor driver c2 outputs the first servo motor drive signal d4 for driving the first servo motor r3 to the first servo motor r3 and also outputs the second servo motor drive signal d5 for driving the second servo motor r6 to the second servo motor r6.

Next is a description of an operation of the phase difference control type tandem press line provided with the workpiece transfer apparatus WC configured as described above.

Figure 2:
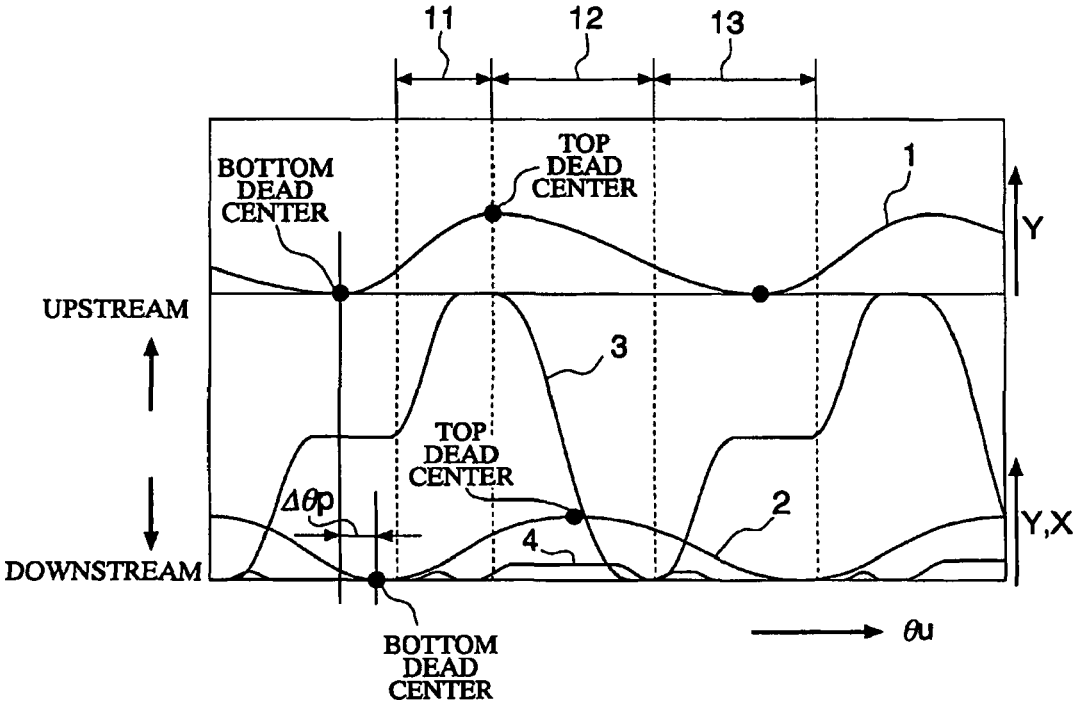
FIG. 2 is a timing chart showing a relationship between an upstream side press angle θu as well as a downstream side press angle θd and a position of a workpiece grip portion r11 on a transfer path H in the first embodiment.

In a phase difference control type tandem press line, an upstream side press angle θu and a downstream side press angle θd are controlled so as to have a predetermined phase difference (a planned phase difference) Δθp. FIG. 2 is a timing chart showing operations of the upstream side die a4 and downstream side die b4 whose phase difference is controlled in this manner, and the workpiece grip portion r11. In this figure, the abscissa axis represents the upstream side press angle θu; reference numeral 1 denotes a positional change of the upstream side die a4 in the Y axis direction; reference numeral 2 denotes a positional change of the downstream side die b4 in the Y axis direction; reference numeral 3 denotes a positional change of the workpiece grip portion r11 on the transfer path H in the X axis direction; and reference numeral 4 denotes a positional change of the workpiece grip portion r11 on the transfer path H in the Y axis direction.

In FIG. 2, in process 11, as the upstream side die a4 moves up toward top dead center, the workpiece grip portion r11 moves toward the workpiece stage a5 (upstream point) of the upstream side press apparatus A, and suction grips the workpiece P on the workpiece stage a5 which has been press molded. In process 12, the workpiece grip portion r11 moves toward the downstream side press apparatus B while suction gripping the workpiece P, and reaches the workpiece stage b5 (downstream point) of the downstream side press apparatus B to carry in the workpiece P during the time when the downstream side die b4 is positioned near top dead center. In process 13, because the upstream side die a4 is positioned near bottom dead center, the workpiece grip portion r11 waits at the midpoint between the upstream side press apparatus A and the downstream side press apparatus B. With the repetition of the above processes, the workpiece P is smoothly transferred without interference between the workpiece grip portion r11 and the upstream side die a4 as well as the down stream side die b4. The planned phase difference Δθp is set in advance to a value which does not allow the workpiece grip portion r11 to interfere with the upstream side die a4 and the down stream side die b4 as described above and which makes the production efficiency highest.

As shown in FIG. 2, the relationship between the positions of the upstream side die a4 as well as the downstream side die b4 on the Y axis and the position of the workpiece grip portion r11 on the transfer path H, that is, the target transfer position is uniquely determined. The target transfer position can be expressed by the functions Fx(θu) and Fy(θu) which take the upstream side press angle θu as a variable. Here, the function which represents the X coordinate value is Fx(θu), and the function which represents the Y coordinate value is Fy(θu). The functions Fx(θu) and Fy(θu) which relate the upstream side press angle θu with the target transfer position of the workpiece grip portion r11 in this manner are referred to as motion profile functions of the workpiece grip portion r11, and the upstream side press angle θu as a variable is referred to as a synchronization object angle.

The planned phase difference Δθp and motion profile functions are established in advance by simulating the operations of FIG. 2. Therefore, in the case of actual transfer control over the workpiece grip portion r11, if only the upstream side press angle θu is detected, it is possible to perform a smooth phase difference control as shown in FIG. 2 by substituting the upstream side press angle θu into the aforementioned motion profile functions to calculate the target transfer position of the workpiece grip portion r11.

The simulation as shown above assumes that a unique relationship between the positions of the upstream side die a4 and downstream side die b4 in the Y axis; that the target transfer position of the workpiece grip portion r11 will not collapse; and that "the upstream side press angle θu=the downstream side press angle θd+the planned phase difference Δθp" always holds. However, in actual press lines, the unique relationship as described above collapses due to a decrease in movement speed of a die generated when the workpiece P is pressed, control error in phase difference control between the upstream side press apparatus A and the downstream side press apparatus B, or the like, and thereby the planned phase difference Δθp is changed from the value acquired from the simulation.

Figure 3A:
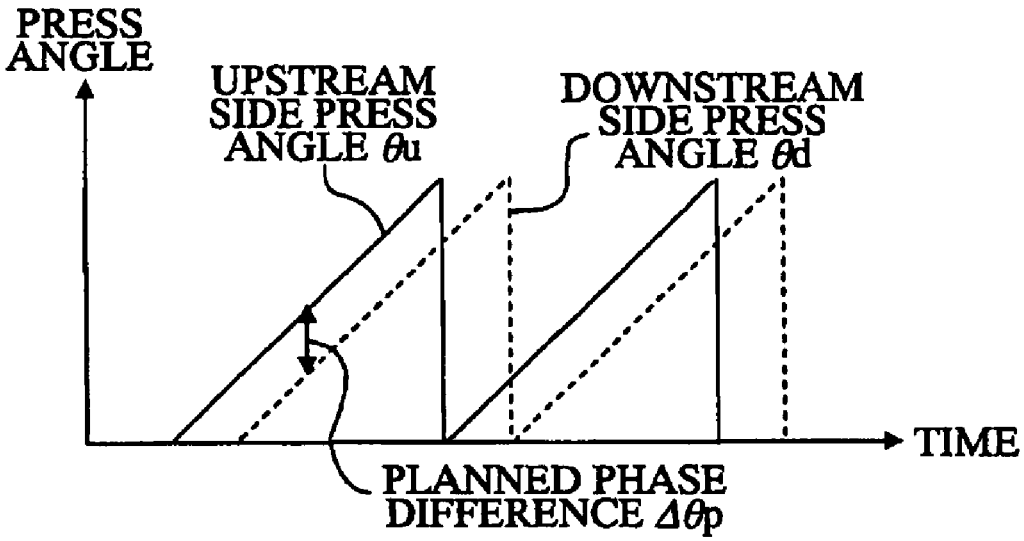
FIG. 3A shows a temporal change in the upstream side press angle θu and the downstream side press angle θd in the first embodiment.
Figure 3B:
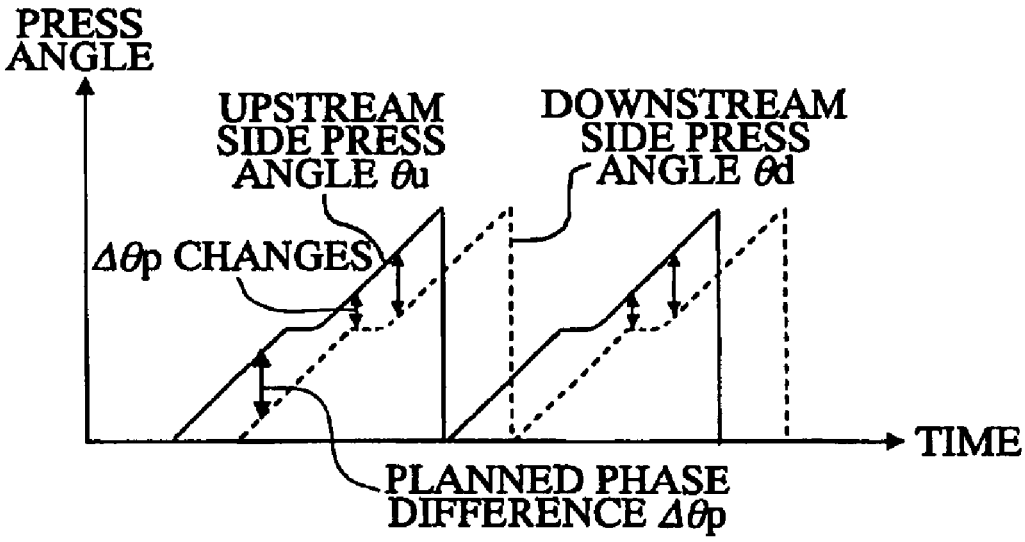
FIG. 3B shows a temporal change in the upstream side press angle θu and the downstream side press angle θd in an actual press line.

FIG. 3A and FIG. 3B show temporal changes in the planned phase difference Δθp. FIG. 3A shows an ideal temporal change in the upstream side press angle θu and the downstream side press angle θd obtained by simulation. In such a case, the planned phase difference Δθp is always constant as shown in the figure. FIG. 3B shows a temporal change in the upstream side press angle θu and the downstream side press angle θd in an actual press line.

In a case such as in FIG. 3B, that is, θu=θd+Δθp does not hold, if the target transfer position of the workpiece grip portion r11 is acquired, in accordance with the simulation, from the motion profile functions that take the upstream side press angle θu as a synchronization object angle and the workpiece grip portion r11 is moved to that XY coordinates, there is a possibility that the downstream side die b4 and the workpiece grip portion r11 interfere with each other. In addition, if in order to prevent such interference between the workpiece grip portion r11 and the downstream side die b4, the synchronization object angle is instantaneously switched from the upstream side press angle θu to the downstream side press angle θd when the workpiece grip portion r11 comes close to the interference area with the downstream side die b4, there is a possibility that sudden acceleration and deceleration is applied to the workpiece grip portion r11 to generate vibration, to thereby cause the workpiece P to fall down or cause the portions of the workpiece transfer portion R with low mechanical rigidity to be damaged.

Figure 4:
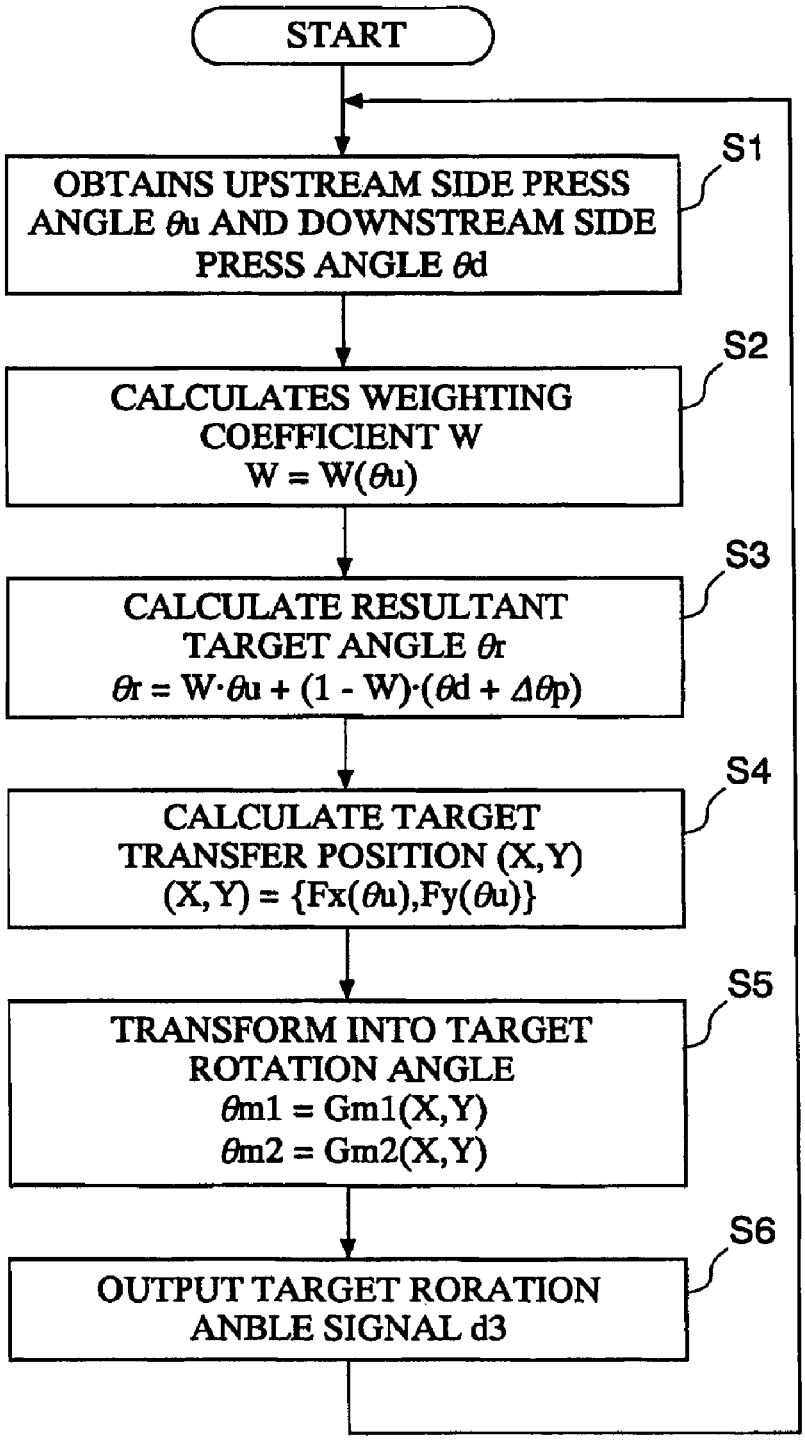
FIG. 4 is a flowchart showing an operation of a target value calculation portion c1 in the first embodiment.

Therefore, in the workpiece transfer apparatus WC in the first embodiment, a resultant target angle θr, which will be described below, is used instead of the synchronization object angle. Hereunder is a detailed description of an operation of the target value calculation portion c1 for calculating this resultant target angle θr, with reference to the operation flowchart shown in FIG. 4.

First, the target value calculation portion c1 obtains the upstream side press angle signal d1, that is, the upstream side press angle θu from the upstream side press angle detector a6, and also obtains the downstream side press angle signal d2, that is, the downstream side press angle θd from the downstream side press angle detector b6 (Step S1).

Figure 5:
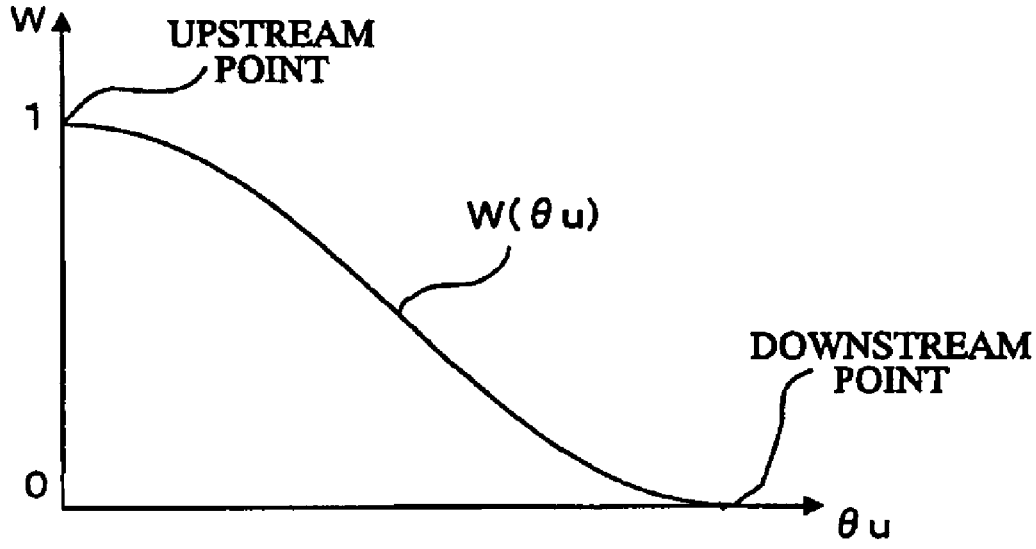
FIG. 5 is a characteristic graph of a weighting function W(θu) in the first embodiment.

Next, the target value calculation portion c1 calculates the weighting coefficient W by substituting the upstream side press angle θu into the weighting function W(θu) (Step S2). This weighting function W(θu) is a cosine function that takes the upstream side press angle θu as a variable, as shown in FIG. 5. Here, the upstream side press angle θu as the variable shows the target transfer position of the workpiece grip portion r11. Therefore, as is seen from this figure, the characteristics are that the weighting coefficient W is high (W=1 at highest) when the workpiece grip portion r11 is positioned in the vicinity of the upstream point, and decreases smoothly and continuously (W=0 at lowest) as it comes closer to the vicinity of the downstream point.

The target value calculation portion c1 then calculates the resultant target angle θr from the aforementioned synthesis equation (1) based on the weighting coefficient W acquired in Step S2, the upstream side press angle θu, the downstream side press angle θd, and the planned phase difference Δθp (Step S3). As is seen from FIG. 5 and the aforementioned synthesis equation (1), when the workpiece grip portion r11 is positioned at the upstream point, the resultant target angle θr becomes equal to the upstream side press angle θu because the weighting coefficient W is 1. The resultant target angle θr smoothly changes in accordance with the characteristics of the weighting function W(θu) as the workpiece grip portion r11 moves to the downstream point. When the workpiece grip portion r11 reaches the downstream point, the resultant target angle θr becomes equal to the downstream side press angle θd+the planned phase difference Δθp because the weighting coefficient W is 0. That is, the weight of the upstream side press angle θu in the resultant target angle θr is increased in the vicinity of the upstream point, and is smoothly decreased as the position is closer to the downstream point.

Therefore, by substituting this resultant target angle θr, instead of the synchronization object angle, into the aforementioned motion profile functions, interference between the upstream side die a4 and the workpiece grip portion r11 can be prevented in the vicinity of the upstream point, and interference between the downstream side die b4 and the workpiece grip portion r11 can be prevented in the vicinity of the downstream point. Furthermore, in the intermediate position between the upstream point and the downstream point, the resultant target angle θr smoothly changes in accordance with the characteristics of the weighting function W(θu), to thereby enable suppression of vibration in the workpiece grip portion r11.

As described above, the target value calculation portion c1, after calculating the resultant target angle θr in Step S3, substitutes the resultant target angle θr into the previously-stored motion profile functions {X=Fx(θu), Y=Fy(θu)}, to thereby calculate the target transfer position of the workpiece grip portion r11 (Step S4).

Subsequently, the target value calculation portion c1 transforms the target transfer position of the workpiece grip portion r11 acquired as above into target rotation angles of the first servo motor r3 and the second servo motor r6 by use of transformation functions (Step S5). Here, let the target rotation angle of the first servo motor r3 be θm1, the transformation function be Gm1(X,Y), and let the target rotation angle of the second servo motor r6 be θm2, the transformation function be Gm2(X,Y), these target rotation angle θm1 and target rotation angle θm2 are represented by the following transformation formulas (2) and (3). Note that the transformation functions Gm1(X,Y) and Gm2(X,Y) are uniquely determined by the configuration of the workpiece transfer portion R (lengths and diameters of the first ball screw r2 and the second ball screw r5, lengths of the first link arm r8, the second link arm r9, and the third link arm r10, or the like).

$$\theta m1 = Gm1(X,Y) \tag{2}$$

$$\theta m2 = Gm2(X,Y) \tag{3}$$

The target value calculation portion c1 then outputs the target rotation angle signal d3 which shows the aforementioned target rotation angles θm1 and θm2 to the servo motor driver c2 (Step S6). Based on the aforementioned target rotation angle signal d3, the servo motor driver c2 generates the first servo motor drive signal d4 and outputs it to the first servo motor r3. The servo motor driver c2 also generates the second servo motor drive signal d5 and outputs it to the second servo motor r6.

The first servo motor r3 rotates by the target rotation angle θm1 based on the aforementioned first servo motor drive signal d4 to drive the first slide r4. The second servo motor r6 rotates by the target rotation angle θm2 based on the aforementioned second servo motor drive signal d5 to drive the second slide r7. As a result, the workpiece grip portion r11 is moved to the target transfer position.

By repeating the operations of Steps S1 to S6 as described above, the target value calculation portion c1 calculates the resultant target angle θr based on the changes in the upstream side press angle θu and the downstream side press angle θd, to thereby control the target transfer position of the workpiece grip portion r11.

As described above, in accordance with the workpiece transfer apparatus WC in the first embodiment, the weighting function W(θu) is used to acquire a resultant target angle θr with the characteristics of increasing the weight of the upstream side press angle θu on the upstream side and smoothly decreasing the weight of the upstream side press angle θu as the position is closer to the downstream side. Controlling the target transfer position of the workpiece grip portion r11 synchronously with this resultant target angle θr enables suppression of vibration in the workpiece grip portion r11, and also enables smooth transfer of the workpiece P without interference between the upstream side die a4 as well as the downstream side die b4 and the workpiece grip portion r11. In addition, this can prevent a workpiece P from falling and damage to the portions of the workpiece transfer portion R with low mechanical rigidity (in other words, there is no need to enhance mechanical rigidity of the workpiece transfer portion R).

Second Embodiment

Next is a description of a second embodiment of the present invention. In this second embodiment, another method for calculating the target transfer position will be described. The second embodiment has the same apparatus configuration as the first embodiment. Therefore, description thereof is omitted, and the following description is mainly for an operation of the target value calculation portion c1.

Figure 6:
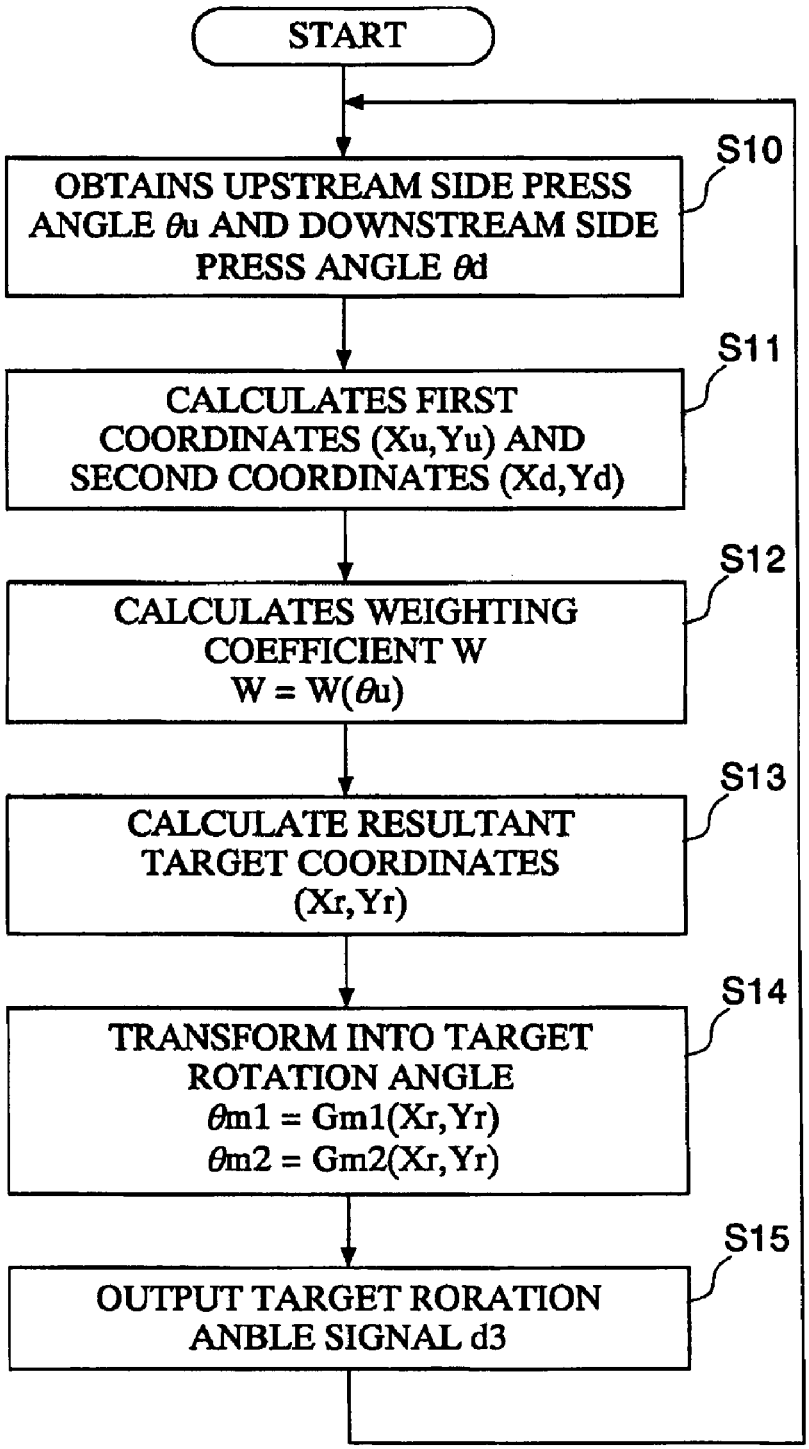
FIG. 6 is a flowchart showing an operation of a target value calculation portion c1 in a second embodiment.

FIG. 6 is an operation flowchart of the target value calculation portion c1 in the second embodiment. First, similarly to the first embodiment, the target value calculation portion c1 obtains the upstream side press angle θu from the upstream side press angle detector a5, and also obtains the downstream side press angle θd from the downstream side press angle detector b6 (Step S10).

Subsequently, the target value calculation portion c1 substitutes the upstream side press angle θu obtained in the aforementioned Step S10 into the motion profile functions {Fx(θu),Fy(θu)} to acquire first coordinates (Xu,Yu)={Fx(θu),Fy(θu)}. The target value calculation portion c1 also substitutes the downstream side press angle θd+the planned phase difference Δθp, instead of the upstream side press angle θu, into the aforementioned motion profile functions {Fx(θu), Fy(θu)} to acquire second coordinates (Xd, Yd)={Fx(θd+Δθp),Fy(θd+Δθp)} (Step S11).

As described in the first embodiment, in an ideal press line where the upstream side press angle θu=the downstream side press angle θd+the planned phase difference Δθp always holds, the first coordinates (Xu,Yu) should be equal to the second coordinates (Xd, Yd). Therefore, in an ideal case like this, if either the first coordinates (Xu, Yu) or the second coordinates (Xd,Yd) are selected as a target transfer position, and the workpiece grip portion r11 is controlled to be moved to the target transfer position, then the workpiece grip portion r11 can transfer the workpiece P without interfering with the upstream side die a4 and the downstream side die b4.

However, as described above, in actual press lines, the unique relationship of the upstream side press angle θu=the downstream side press angle θd+the planned phase difference Δθp collapses due to a decrease in movement speed of a die generated when the workpiece P is pressed, a control error in phase difference control between the upstream side press apparatus A and the downstream side press apparatus B, or the like, and thereby the planned phase difference Δθp is changed from the value acquired from the simulation. As a result, the aforementioned first coordinates (Xu,Yu) becomes different from the aforementioned second coordinates (Xd,Yd). Therefore, for example, if the first coordinates (Xu,Yu) are selected as a target transfer position and the workpiece grip portion c11 is controlled to move to the target transfer position, there is a possibility that the workpiece grip portion r11 will interfere with the downstream side die b4 because the unique relationship between the position of the downstream side die b4 and the target transfer position no longer holds. Similarly, in the case where the second coordinates (Xd,Yd) are selected instead as a target transfer position, there is a possibility that the workpiece grip portion r11 will interfere with the upstream side die a4.

Therefore, similarly to the first embodiment, the target value calculation portion c1 substitutes the upstream side press angle θu into the weighting function W(θu) of FIG. 5 to calculate the weighting coefficient W (Step S12), and combines the respective X coordinate value and respective Y coordinate values of the first coordinates (Xu,Yu) and second coordinates (Xd,Yd) from the following synthesis equations (4) and (5) to calculate the resultant target coordinates (Xr,Yr) (Step S13).

$$Xr=W\cdot Xu+(1-W)Xd \tag{4}$$

$$Yr=W\cdot Yu+(1-W)Yd \tag{5}$$

When the aforementioned resultant target coordinates (Xr, Yr) are used for the target transfer position of the workpiece grip portion r11, increase in weight of the first coordinates (Xu,Yu) which take the upstream side press angle θu as the synchronization object angle can prevent interference of the workpiece grip portion r11 with the upstream side die a4 in the vicinity of the upstream side press apparatus A (where the weighting coefficient W comes closer to 1); increase in weight of the second coordinates (Xd,Yd) which take the downstream side press angle θd+the planned phase difference Δθp as the synchronization object angle can prevent interference of the workpiece grip portion r11 with the downstream side die b4 in the vicinity of the downstream side press apparatus B (where the weighting coefficient W comes closer to 0); and vibration in the workpiece grip portion r11 can be prevented because the weighting coefficient W smoothly changes in accordance with the characteristics shown in FIG. 5 as the workpiece grip portion r11 is moved from the upstream side press apparatus A to the downstream side press apparatus B.

The target value calculation portion c1 then, similarly to the first embodiment, uses the following transformation formulas (6) and (7) to transform the resultant target coordinates (Xr,Yr) of the workpiece grip portion r11 acquired as described above into target rotation angles of the first servo motor r3 and the second servo motor r6 (Step S14). Here, a target rotation angle of the first servo motor r3 is θm1, and a transformation function thereof is Gm1(Xr,Yr); and a target rotation angle of the second servo motor r6 is θm2, and a transformation function thereof is Gm2(Xr,Yr).

$$\theta m1=Gm1(Xr,Yr) \tag{6}$$

$$\theta m2=Gm2(Xr,Yr) \tag{7}$$

The target value calculation portion c1 then outputs the target rotation angle signal d3 which shows the aforementioned target rotation angles θm1 and θm2 to the servo motor driver c2 (Step S15). Based on the aforementioned target rotation angle signal d3, the servo motor driver c2 generates the first servo motor drive signal d4 and the second servo motor drive signal d5 and outputs them respectively to the first servo motor r3 and the second servo motor r6.

The first servo motor r3 rotates by the target rotation angle θm1 based on the aforementioned first servo motor drive signal d4 to linearly drive the first slide r4. The second servo motor r6 rotates by the target rotation angle θm2 based on the aforementioned second servo motor drive signal d5 to linearly drive the second slide r7. As a result, the workpiece grip portion r11 is moved to the resultant target coordinates (Xr, Yr).

As described above, similarly to the first embodiment, the second embodiment enables suppression of vibration in the workpiece grip portion r11, and also enables smooth transfer of the workpiece P without interference between the upstream side die a4 as well as the downstream side die b4 and the workpiece grip portion r11.

The present invention is not limited to the aforementioned embodiments. For example, it is possible to conceive the following modifications.

Figure 7A:
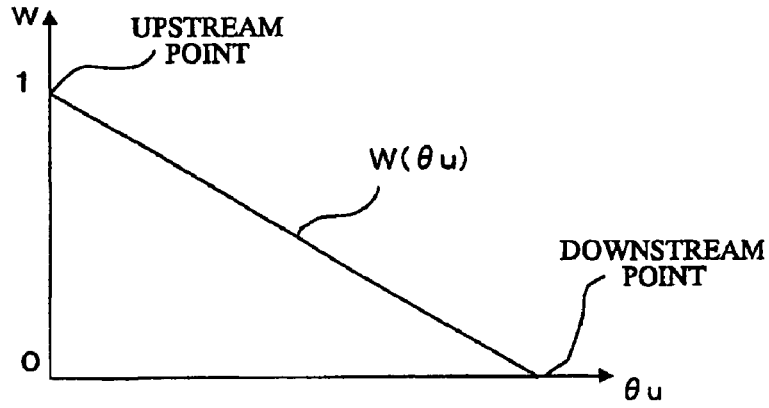
FIG. 7A shows an alternative example in the weighting function W(θu) in the first and second embodiments.
Figure 7B:
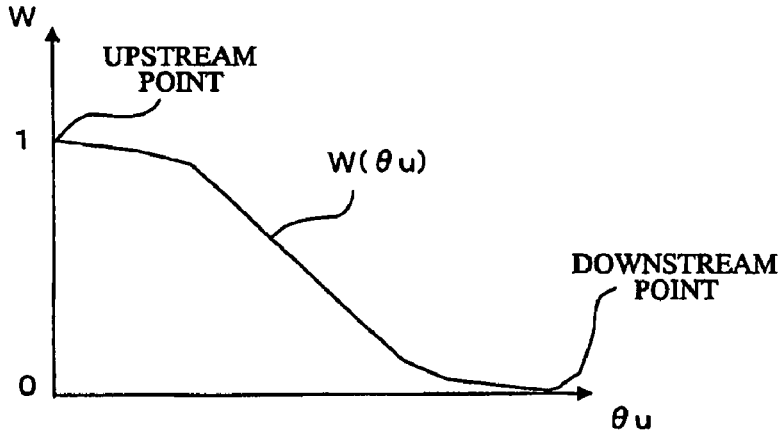
FIG. 7B shows another alternative example in the weighting function W(θu) in the first and second embodiments.

(1): In the aforementioned first and second embodiments, a cosine function is defined as the weighting function W(θu). However, the invention is not limited thereto. A function as shown in FIG. 7A may be adopted which monotonously decreases and is continuous. Furthermore, the function may be defined by combination of lines, as shown in FIG. 7B. Other than these, any function may be used as the weighting function W(θu) as long as it has characteristics such as increasing the weight of the upstream side press angle θu near the upstream point and decreasing the weight of the upstream side press angle θu near the downstream point. However, functions which have a sudden change that will generate vibration in the workpiece grip portion r11 cannot be used as the weighting function W(θu).

For example, functions which can be used as the weighting function W(θu) include: sigmoid functions such as a sigmoid logistic function, a sigmoid Richards function, and a sigmoid Weibull function; or a Boltzman function; a Hill function; and a Gompertz function.

Furthermore, as the weighting function W(θu), a function as is represented by a cam curve may be adopted. As a cam curve, for example a modified trapezoid curve, a modified sine curve, any of the third- to fifth-order polynomial curves, or the like may be used. In the case where the function or curve as described above is used as the weighting function W(θu), it is obvious that the upstream side press angle θu is taken as the variable.

Figure 7C:
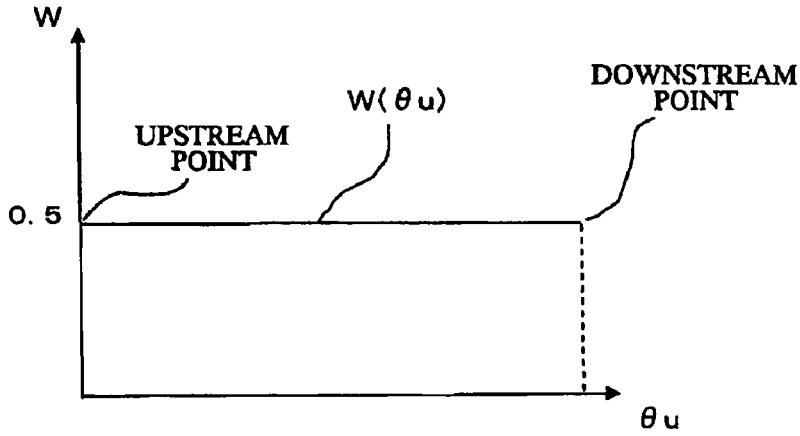
FIG. 7C shows another alternative example in the weighting function W(θu) in the first and second embodiments.

Moreover, the weighting function W(θu) may be not a function of the upstream side press angle θu but a constant as shown in FIG. 7C. For example, letting W=0.5, the upstream side press angle θu and the downstream side press angle θd+the planned phase difference Δθp are always combined in an even ratio from the aforementioned synthesis equation (1). Therefore, an effect of the change in the planned phase difference Δθp as shown in FIG. 3B can be averaged and reduced, to thereby decrease the possibility of interference between the workpiece grip portion r11 and the die.

(2): In the aforementioned first embodiment, after defining the weighting function W(θu) and substituting the upstream side press angle θu into it to calculate the weighting coefficient W, the resultant target angle θr is acquired from the aforementioned synthesis equation (1). However, the invention is not limited thereto. The aforementioned resultant target angle θr may be previously set in a table which takes the upstream side press angle θu and the downstream side press angle θd as variables, and a resultant target angle θr may be retrieved from the table based on the upstream side press angles θu and the downstream side press angles θd given from the respective press apparatuses. Similarly, also in the second embodiment, the resultant target coordinates (Xr,Yr) may be previously set in tables which take first coordinates (Xu,Yu) and second coordinates (Xd,Yd) as variables (for example, a table for finding an Xr value of the resultant target coordinates and a table for finding a Yr value thereof may be established), and after calculating the first coordinates (Xu,Yu) and the second coordinates (Xd,Yd) from the motion profile functions based on the upstream side press angles θu and the downstream side press angles θd given from the respective press apparatuses, the resultant target coordinates (Xr,Yr) may be retrieved from the aforementioned two tables.

(3): In the aforementioned first and second embodiments, as the variable for the weighting function W(θu), the upstream side press angle θu is used. However, the invention is not limited thereto. For example, the downstream side press angle θd may be used. Alternatively, one which shows a target transfer position of the workpiece grip portion r11, for example a time obtained by dividing the upstream side press angle θu or the downstream side press angle θd by the rotation speed thereof, or the like may be used.

(4): In the aforementioned first and second embodiments, the workpiece grip portion r11 has only two movement directions, that is, the X and Y axis directions. However, the invention is not limited thereto. The workpiece grip portion r11 may have another movement direction such as a direction of a tilt movement in the XY plane or the like. In this case, a resultant target value also for the tilt movement is acquired by use of the weighting function W(θu). As a result, it is possible to prevent the workpiece grip portion r11 from interfering with the die of the respective press apparatuses, and to suppress vibration in the workpiece grip portion r11.

INDUSTRIAL APPLICABILITY

In accordance with the present invention, a workpiece transfer apparatus which grips a workpiece by use of a predetermined grip device and transfers the workpiece between press apparatuses each of which drives a die, is characterized by including a transfer control device for controlling a position of the grip device based on a resultant target value acquired by combining an upstream side die position and a downstream side die position, in which the transfer control device sets a resultant target value so that the grip device moves smoothly. That is, smooth movement of the grip device can prevent sudden acceleration and deceleration of the grip device, and can suppress vibration of the workpiece transfer apparatus. In addition, this can prevent a workpiece from falling and damage to the portions of the workpiece transfer apparatus with low mechanical rigidity (in other words, there is no need to enhance mechanical rigidity of the workpiece transfer portion R).

The invention claimed is:

1. A workpiece transfer apparatus which grips a workpiece by use of a predetermined grip device and transfers the workpiece between press apparatuses each of which drives a die, comprising a transfer control device for controlling the position of the grip device based on a resultant target value obtained by combining an upstream side die position and a downstream side die position, wherein the transfer control device sets a resultant target value so that the grip device smoothly moves, and wherein the upstream side die position is a die position of a press apparatus located on an upstream side of a workpiece transfer direction, and the downstream side die position is a die position of a press apparatus located on a downstream side of a workpiece transfer direction.

2. The workpiece transfer apparatus in accordance with claim 1, wherein in a case where an upstream side die position is given as an upstream side press angle θu and a downstream side die position is given as a downstream side press angle θd by respective press apparatuses, the transfer control device sets a resultant target angle θr as a resultant target value, in which the resultant target angle θr is obtained by substituting the upstream side press angle θu and the downstream side press angle θd into the following synthesis equation (1) which is related to a phase difference Δθp between the two and a weighting coefficient W:

$$\theta r = W \cdot \theta u + (1 - W) \cdot (\theta d + \Delta\theta p) \quad (1).$$

3. A press line, comprising: a plurality of press apparatuses which are arranged at predetermined intervals and each of which drives a die; and a workpiece transfer apparatus in accordance with claim 2 which is provided between an upstream side press apparatus and a downstream side press apparatus to transfer a workpiece.

4. The workpiece transfer apparatus in accordance with claim 2, wherein the weighting coefficient W represents a decreasing and continuous function value which takes the upstream side press angle θu as a variable.

5. A press line, comprising: a plurality of press apparatuses which are arranged at predetermined intervals and each of which drives a die; and a workpiece transfer apparatus in accordance with claim 4 which is provided between an upstream side press apparatus and a downstream side press apparatus to transfer a workpiece.

6. The workpiece transfer apparatus in accordance with claim 1, wherein in a case where an upstream side die position is given as an upstream side press angle θu and a downstream side die position is given as a downstream side press angle θd by respective press apparatuses, the transfer control device acquires first coordinates (Xu, Yu) of the grip device based on the upstream side press angle θu and also acquires second coordinates (Xd, Yd) of the grip device based on the downstream side press angle θd, and then sets resultant target coordinates (Xr, Yr) as a resultant target value, in which the resultant target coordinates (Xr, Yr) is obtained by substituting the first coordinates (Xu, Yu) and the second coordinates (Xd, Yd) into the following synthesis equations (4) and (5) which are related to a weighting coefficient W:

$$Xr=W\cdot Xu+(1-W)Xd \quad (4)$$

$$Yr=W\cdot Yu+(1-W)Yd \quad (5).$$

7. The workpiece transfer apparatus in accordance with claim 6, wherein the weighting coefficient W represents a decreasing and continuous function value which takes the upstream side press angle θu as a variable.

8. A press line, comprising: a plurality of press apparatuses which are arranged at predetermined intervals and each of which drives a die; and a workpiece transfer apparatus in accordance with claim 6 which is provided between an upstream side press apparatus and a downstream side press apparatus to transfer a workpiece.

9. The workpiece transfer apparatus in accordance with claim 1, wherein in a case where an upstream side die position is given as an upstream side press angle θu and a downstream side die position is given as a downstream side press angle θd by respective press apparatuses, the transfer control device sets the resultant target value by retrieving, based on the upstream side press angle θu and the downstream side press angle θd which are given by the respective press apparatuses, a table in which resultant target values are set in advance with the upstream side press angle θu and the downstream side press angle θd as variables.

10. A press line, comprising: a plurality of press apparatuses which are arranged at predetermined intervals and each of which drives a die; and a workpiece transfer apparatus in accordance with claim 9 which is provided between an upstream side press apparatus and a downstream side press apparatus to transfer a workpiece.

11. The workpiece transfer apparatus in accordance with claim 1, wherein in a case where an upstream side die position is given as an upstream side press angle θu and a downstream side die position is given as a downstream side press angle θd by respective press apparatuses, the transfer control device acquires first coordinates (Xu, Yu) of the grip device as a calculated value based on the upstream side press angle θu and also finds second coordinates (Xd, Yd) of the grip device as a calculated value based on the downstream side press angle θd, and then sets the resultant target value by retrieving, based on the calculated values, a table in which resultant target values are set in advance with the first coordinates (Xu, Yu) and the second coordinates (Xd, Yd) as variables.

12. A press line, comprising: a plurality of press apparatuses which are arranged at predetermined intervals and each of which drives a die; and a workpiece transfer apparatus in accordance with claim 11 which is provided between an upstream side press apparatus and a downstream side press apparatus to transfer a workpiece.

13. A press line, comprising: a plurality of press apparatuses which are arranged at predetermined intervals and each of which drives a die; and a workpiece transfer apparatus in accordance with claim 1 which is provided between an upstream side press apparatus and a downstream side press apparatus to transfer a workpiece.

14. A control method for a workpiece transfer apparatus which grips a workpiece by use of a predetermined grip device and transfers the workpiece between press apparatuses each of which drives a die, comprising a step of controlling a position of the grip device based on a resultant target value obtained by combining an upstream side die position and a downstream side die position, wherein a resultant target value is set in the step of controlling the position of the grip device so that the grip device moves smoothly, and wherein the upstream side die position is a die position of a press apparatus located on an upstream side in a workpiece transfer direction, and the downstream side die position is a die position of a press apparatus located on a downstream side in a workpiece transfer direction.

* * * * *